US006302281B1

(12) United States Patent
Wang

(10) Patent No.: US 6,302,281 B1
(45) Date of Patent: Oct. 16, 2001

(54) CLOTHES CONTAINER SUPPORT FRAME STRUCTURE ADAPTED TO HOLD A CLOTHES CONTAINER IN A WARDROBE

(76) Inventor: Wen-Tsan Wang, P.O. Box 82-144, Taipei (TW)

( * ) Notice: Subject to any disclaimer, the term of this patent is extended or adjusted under 35 U.S.C. 154(b) by 0 days.

(21) Appl. No.: 09/591,557

(22) Filed: Jun. 9, 2000

(51) Int. Cl.[7] ..... A47F 5/00

(52) U.S. Cl. ..... 211/118; 211/119; 211/123; 206/287; 190/13 R

(58) Field of Search ..... 211/113, 118, 211/119, 123; 206/286, 287, 289; 190/13 R

(56) References Cited

U.S. PATENT DOCUMENTS 1,375,883 * 4/1921 Woolson .
2,016,520 * 10/1935 Short .
2,643,003 * 6/1953 Christie .
2,645,541 * 7/1953 Mintz et al. .
2,670,854 * 3/1954 Einhorn .
2,671,706 * 3/1954 Greengold .
3,335,826 * 8/1967 Swivles .
4,129,218 * 12/1978 Koellner ..... 211/119 X
5,143,214 * 9/1992 Freelander et al. ..... 206/287

* cited by examiner

*Primary Examiner*—Robert W. Gibson, Jr.
(74) *Attorney, Agent, or Firm*—A & J

(57) ABSTRACT

A clothes container support frame structure adapted for hanging on a rod member in a wardrobe to hold a flexible clothes container. The clothes container support frame structure includes an open frame, two hook holders coupled to the open frame at two opposite lateral sides, two hooks respectively coupled to the hook holders for hanging the hook holder and the open frame on a rod member in a wardrobe, a plurality of washers respectively mounted on the hooks and supported on the hook holders, two hanging wires respectively hung on the open frame at two opposite lateral sides, and a rack suspended from the hanging wires and adapted to hold clothes hangers, the rack having a top protruded portion, which supports the top panel of the flexible clothes container in which the clothes container support frame structure is installed.

6 Claims, 6 Drawing Sheets

CLOTHES CONTAINER SUPPORT FRAME STRUCTURE ADAPTED TO HOLD A CLOTHES CONTAINER IN A WARDROBE

BACKGROUND OF THE INVENTION

The present invention relates to a clothes container support frame structure adapted to hold a clothes container in a wardrobe, and more particularly to such a clothes container support frame structure, which effectively stops dust from entering the clothes container in which the clothes container support frame structure is installed.

Flexible clothes containers may be used in a wardrobe to hold classified clothes. Various support frame structures have been disclosed for use to hold flexible clothes containers in wardrobes. A regular support frame structure for this purpose is known comprised of a support frame adapted to support a flexible clothes container in shape, and hooks mounted on the support frame and extended out of the flexible clothes container for hanging on a rod member in a wardrobe. This design of support frame structure has numerous drawbacks as outlined hereinafter.

1. After installation of the support frame structure in a flexible clothes container, dust may pass to the inside of the flexible clothes container through the gaps between the top panel of the flexible clothes container and the hooks.
2. Because the support frame simply extends along the border area of the top panel of the flexible clothes container, the support frame structure cannot positively support the top panel of the flexible clothes container against deformation.
3. The complicated support frame complicates the assembly process of the support frame structure.

SUMMARY OF THE INVENTION

It is one object of the present invention to provide a clothes container support frame structure, which has means to reinforce the strength of the top panel of the flexible clothes container in which the clothes container support frame structure is installed. It is another object of the present invention to provide a clothes container support frame structure, which effectively stops dust from entering the flexible clothes container in which the clothes container support frame structure is installed. It is still another object of the present invention to provide a clothes container support frame structure, which is easy to install. According to one aspect of the present invention, the clothes container support frame structure comprises an open frame, two hook holders coupled to the open frame at two opposite lateral sides, two hooks respectively coupled to the hook holders for hanging the hook holder and the open frame on a rod member in a wardrobe, two hanging wires respectively hung on the open frame at two opposite lateral sides, and a rack suspended from the hanging wires and adapted to hold clothes hangers. According to another aspect of the present invention, a plurality of washers are respectively mounted on the hooks and supported on the hook holders and adapted to seal the hook insertion holes on the top panel of the flexible clothes container in which the clothes container support frame structure is installed. According to still another aspect of the present invention, the rack has a top protruded portion, which supports the middle part of the top panel of the flexible clothes container in which the clothes container support frame structure is installed.

DETAILED DESCRIPTION OF THE PREFERRED EMBODIMENT

Figure 1:
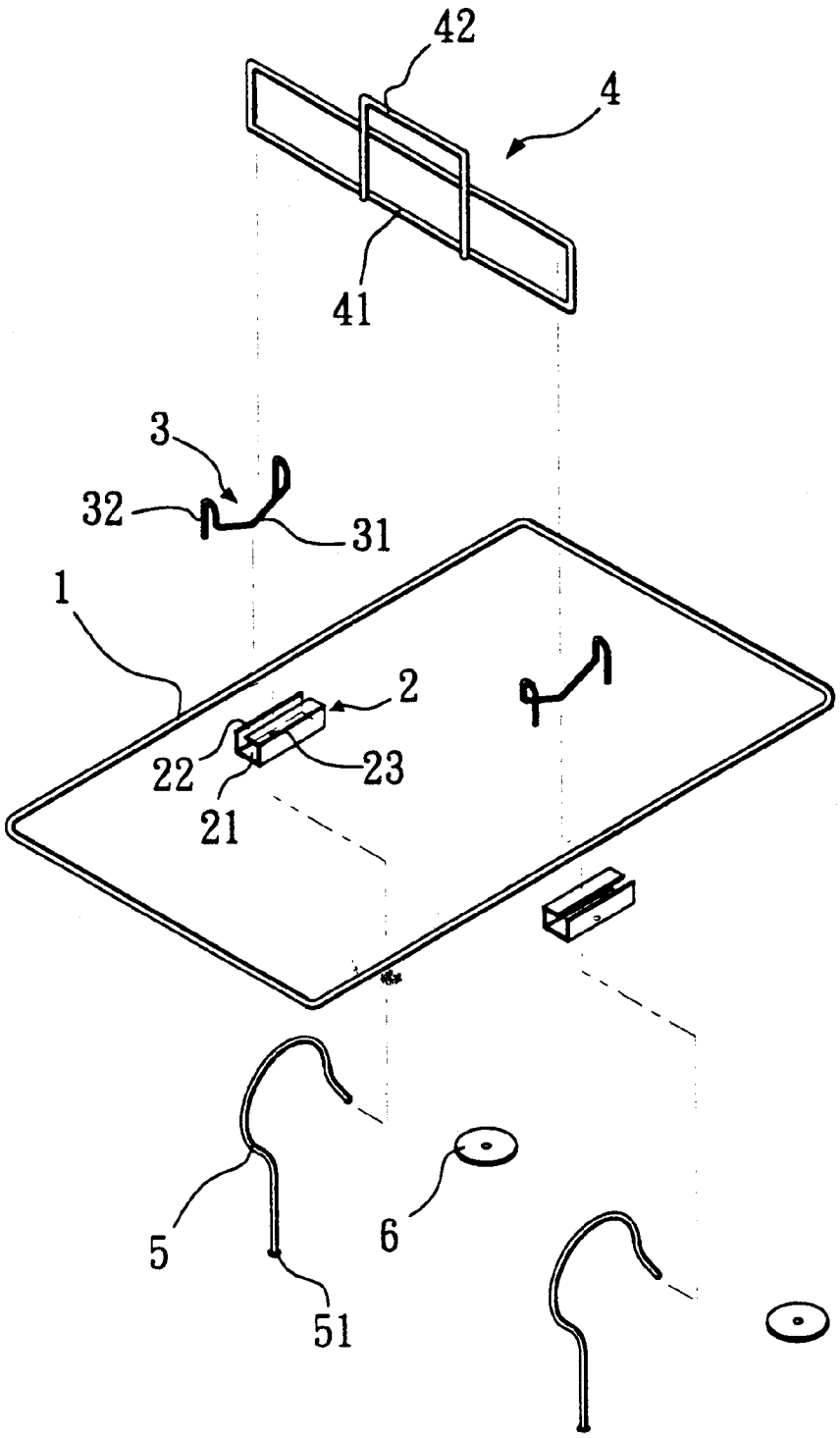
FIG. 1 is an exploded view of a clothes container support frame structure according to one embodiment of the present invention.
Figure 2:
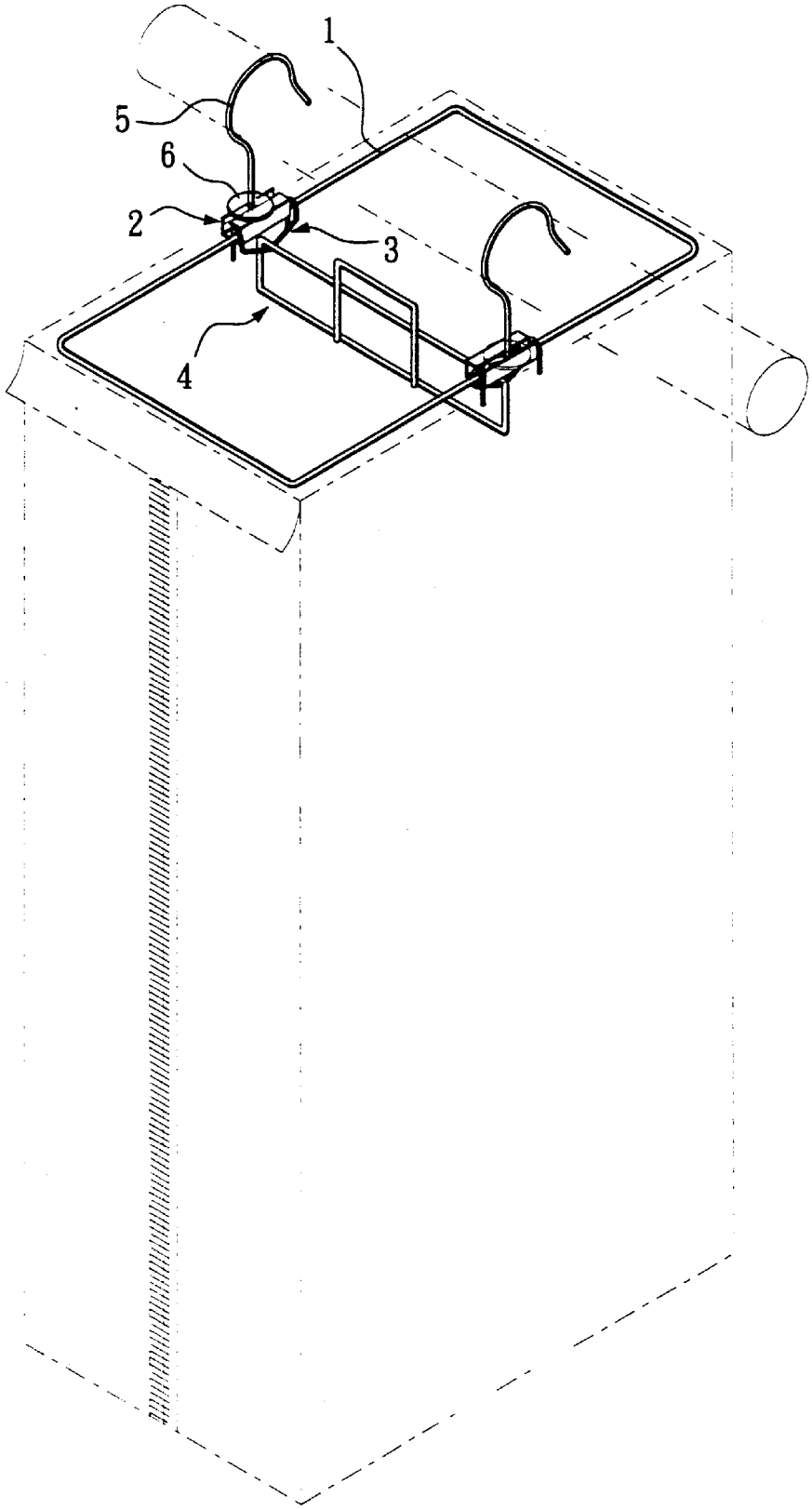
FIG. 2 illustrates the clothes container support frame structure installed in a clothes container according to the present invention.
Figure 3:
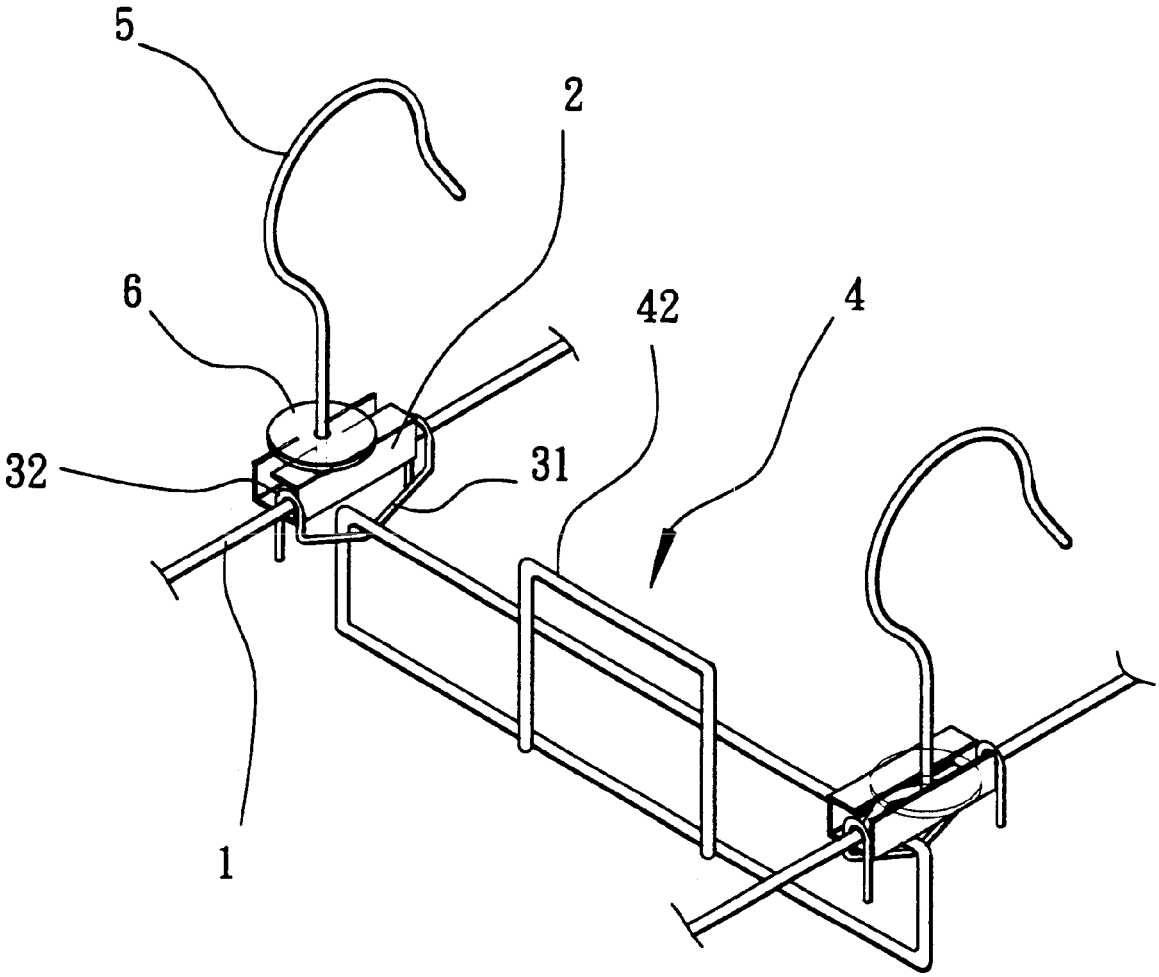
FIG. 3 is a perspective view in an enlarged scale of a part of the present invention.
Figure 4:
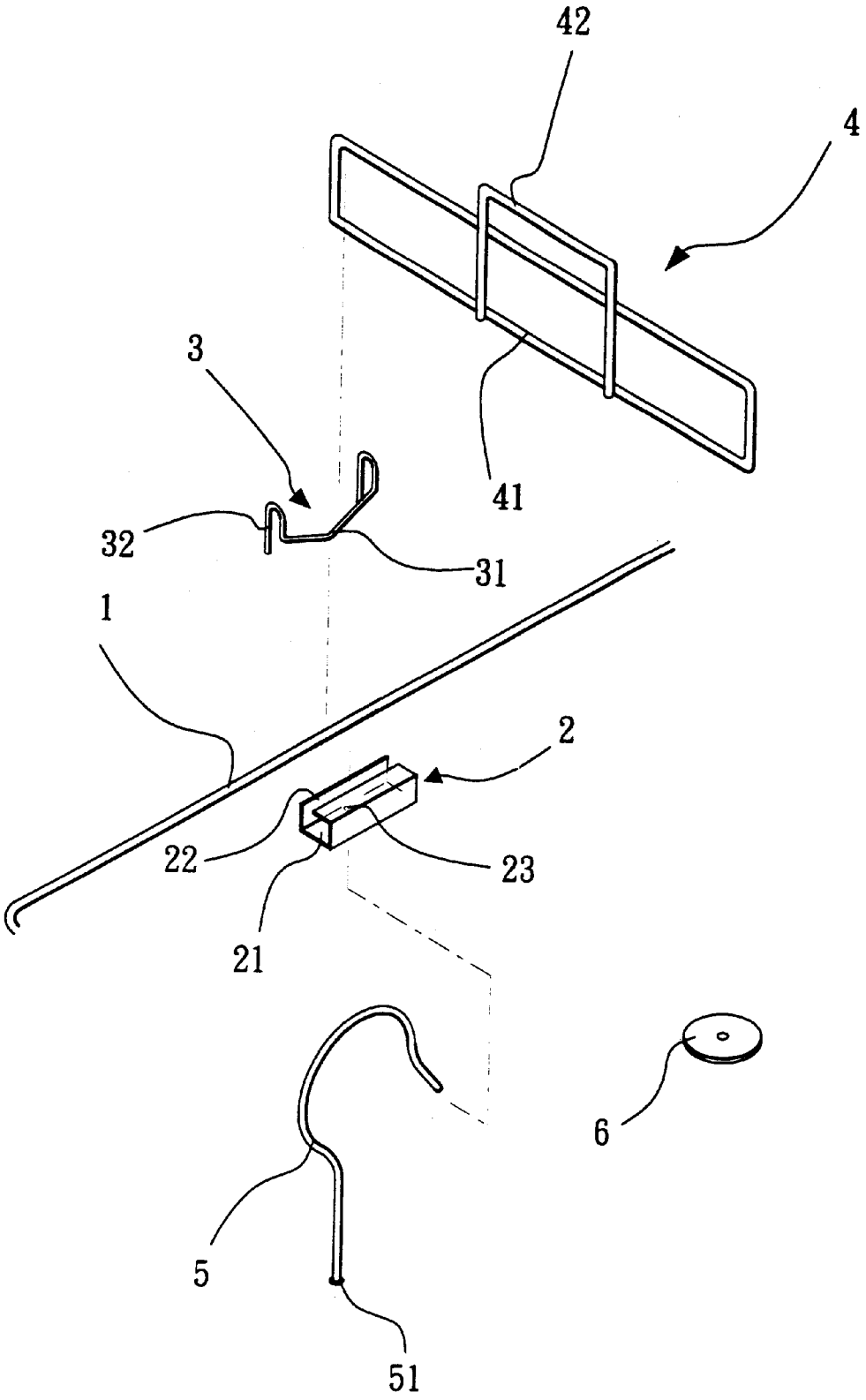
FIG. 4 is an enlarged view of a part of FIG. 1.

Referring to FIG. 1, a clothes container support frame structure f or wardrobe in accordance with the present invention is generally comprised of a wire-rod frame 1, two hook holders 2, two hanging wires 3, a rack 4, two hooks 5, and two washers 6. The wire-rod frame 1 is made by bending, a metal wire rod into the desired shape (for example, rectangular shape) adapted to support a flexible clothes container in shape. After having been bent into the desired shape, the two distal ends of the metal wire rod are welded together. The hook holders 2 are respectively made by bending a metal sheet into hollow, substantially rectangular shell, comprising a longitudinal open space 21, a longitudinally extended top entrance 22 through the metal wire rod of the wire-rod frame 1 is inserted into the longitudinal open space 21, and a bottom through hole 23 disposed in communication with the longitudinal open space 21. The width of the longitudinally extended top entrance 22 is approximately equal to the diameter of the metal wire rod of the wire-rod frame 1. Bending a metal wire rod in to shape, having a stop flange 51 at one end thereof, respectively makes the hooks 5. The washers 6 are respectively molded from plastics, each having a center through hole for the insertion of one hook 5. The hanging wires 3 each comprise two hooked end portions 32 and a middle bearing portion 31 connected between the hooked end portions 32. The middle bearing portion 31 has a substantially V-shaped profile. The rack 4 is made by welding metal wire rods together, comprising a bottom hanging rod 41 for hanging clothes hangers, and a top protruded portion 42.

Referring to FIGS. from 2 through 4 and FIG. 1 again, the two hook holders 2 are respectively coupled to the wire-rod frame 1 at two opposite lateral sides, enabling the two opposite lateral side sections of the wire rod of the wire-rod frame 1 to be respectively inserted through the top entrance 22 on the respective hook holder 2 into the corresponding longitudinal open space 21, and then the hooks 5 are respectively inserted through the bottom through hole 23 on the respective hook holder 2 in direction from the bottom side toward the top side, enabling the stop flange 51 of each hook 5 to be stopped at the bottom side wall of the corresponding hook holder 2, and then the washers 6 are respectively mounted on the hooks 5 and supported on the hook holders 2 to close the top entrance 22 of each hook holder 2, and then the hanging wires 3 are respectively inserted open spaces in two distal ends of the rack 4 and hung on the wire-rod frame 1 to hold the rack 4 between the two opposite lateral side sections of the wire rod of the wire-rod frame 1. When assembled, the hooked end portions 32 of each hanging wire 3 are hooked on the wire rod of the wire-rod frame 1 and stopped at two distal ends of one hook holder 2. When in use, the clothes container support frame structure is put inside the clothes container, and the hooks 5 are inserted through respective through hole on the top panel of the clothes container and hung on a rod member inside the wardrobe. When installed, the wire-rod frame 1 supports the clothes container in shape, the top protruded portion 42 of the rack 4 is stopped at the bottom side wall of the top panel of the clothes container to give a support, and the washers 6 are maintained in close contact with the bottom side wall of the top panel of the clothes container to stop dust from entering the clothes container through the through holes, which receive the hooks 5.

Figure 5:
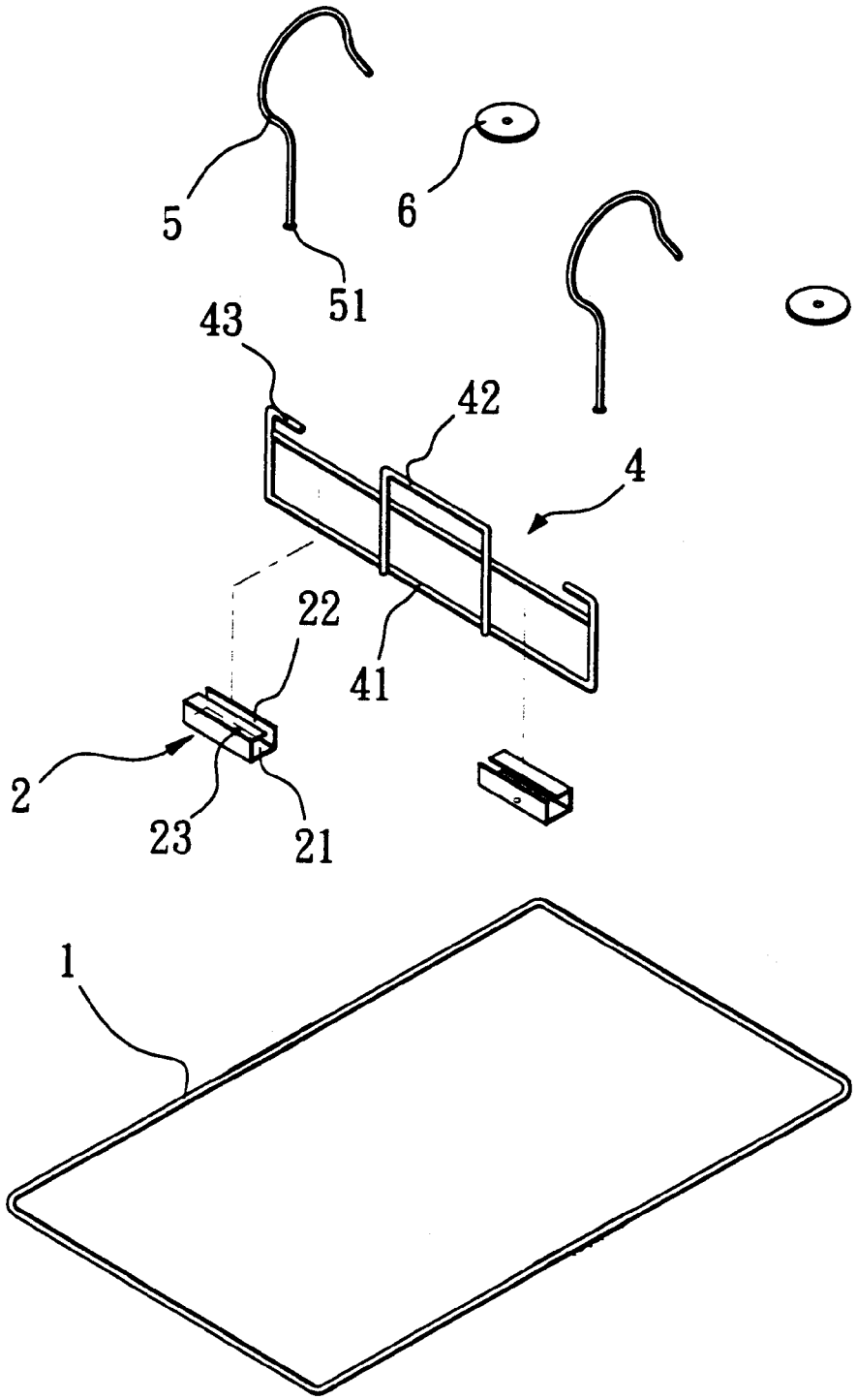
FIG. 5 is an exploded view of an alternate form of the clothes container support frame structure according to the present invention.
Figure 6:
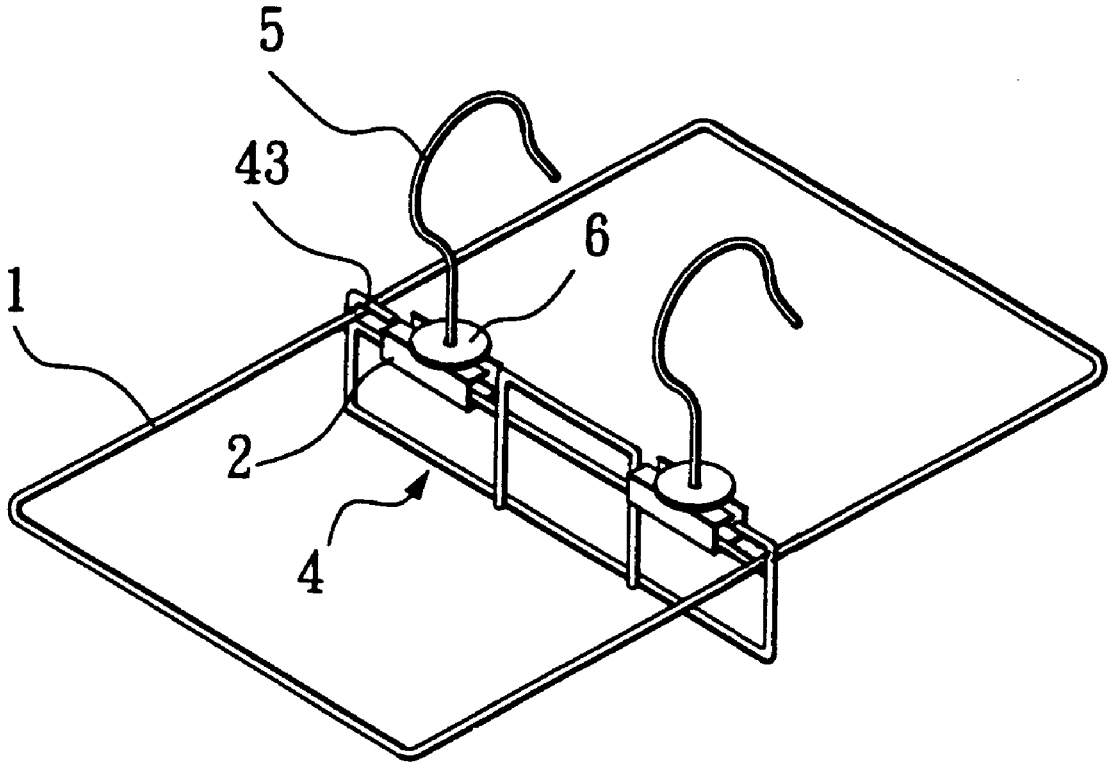
FIG. 6 is a perspective assembly view of the clothes container support frame structure shown in FIG. 5.

FIGS. 5 and 6 show an alternate form of the present invention. This alternate form eliminates the aforesaid hanging wires 3. According to this alternate form, the rack 4 has two hooked portions 43 respectively hooked on the two opposite lateral side sections of the wire rod of the wire-rod frame 1, the hook holders 2 are directly mounted on the rack 4 at two sides of the top protruded portion 42 to hold the hooks 5 and the washers 6 around the hooks 5.

It is to be understood that the drawings are designed for purposes of illustration only, and are not intended for use as a definition of the limits and scope of the invention disclosed.

What the invention claimed is:

1. A clothes container support frame structure comprising:

an open frame formed of a metal wire rod and adapted for supporting a flexible clothes container in shape;

at least one pair of hook holders respectively coupled to said open frame at two opposite lateral sides, said hook holders each comprising a longitudinal open space, which receives a part of said open frame, a longitudinally extended top entrance through which the part of said open frame is inserted into said longitudinal open space, and a bottom through hole;

at least one pair of hooks respectively installed in the bottom through hole on each of said hook holders for hanging on a rod member in a wardrobe, said hooks each having an end stop flange stopped below the bottom through hole on the corresponding hook holder;

a plurality of washers respectively mounted on said hooks and supported on said hook holders;

at least one pair of hanging members respectively hung on said open frame at two opposite lateral sides adjacent to said hook holders, said hanging members each having two hooked end portions respectively hooked on said open frame, and a middle bearing portion connected between said hooked end portions; and at least one rack respectively suspended from the middle bearing portions of said at least one pair of hanging members and adapted to hold clothes hangers, said at least one rack each having a top protruded portion adapted to support the top panel of the flexible clothes container in which the clothes container support frame structure is installed.

2. The clothes container support frame structure of claim 1 wherein the longitudinally extended top entrance of each of said hook holder has a width approximately equal to the diameter of the metal wire rod of said open frame.

3. The clothes container support frame structure of claim 1 wherein said hook holders are respectively made of a metal sheet through a bending process.

4. The clothes container support frame structure of claim 1 wherein the middle bearing portion of each of said hanging members has a V-shaped profile.

5. The clothes container support frame structure of claim 4 wherein said hanging members are respectively made of metal wire rods by through a bending process.

6. A clothes container support frame structure comprising:

an open frame formed of a metal wire rod and adapted for supporting a flexible clothes container in shape;

at least one rack respectively transversely suspended from said open frame and adapted to hold clothes hangers, said at least one rack each comprising two hooked portions respectively disposed at two distal ends and respectively hooked on said open frame, and a top protruded portion;

at least one pair of hook holders respectively coupled to said at least one rack, said hook holders each comprising a longitudinal open space, which receives a part of one of said at least one rack, a longitudinally extended top entrance through which the part of the corresponding rack is inserted into said longitudinal open space, and a bottom through hole;

at least one pair of hooks respectively installed in the bottom through hole on each of said hook holders for hanging on a rod member in a wardrobe, said hooks each having an end stop flange stopped below the bottom through hole on the corresponding hook holder; and a plurality of washers respectively mounted on said hooks and supported on said hook holders.

* * * * *